US005468300A

United States Patent [19]

Monclin

[11] Patent Number: 5,468,300

[45] Date of Patent: Nov. 21, 1995

[54] PROCESS FOR PRODUCING REFINED SUGAR DIRECTLY FROM SUGARCANE

[75] Inventor: Jean-Pierre Monclin, Wilmar, Minn.

[73] Assignee: International Food Processing Incorporated, Thibodaux, La.

[21] Appl. No.: 224,319

[22] Filed: Apr. 7, 1994

[51] Int. Cl.[6] ..... C13D 1/00; C13D 3/12; C13D 3/16

[52] U.S. Cl. ..... 127/43; 127/42; 127/53; 127/55; 127/56

[58] Field of Search ..... 127/43, 53, 42, 127/55, 56

[56] References Cited

U.S. PATENT DOCUMENTS

| | | | |
|---|---|---|---|
| 2,593,540 | 4/1952 | Cornwell et al. | 210/8.5 |
| 2,610,932 | 9/1952 | Eakin | 127/55 |
| 3,228,876 | 1/1966 | Mahon | 210/22 |
| 3,298,865 | 1/1967 | Bode | 127/55 |
| 3,342,729 | 9/1967 | Strand | 210/23 |
| 3,781,174 | 12/1973 | Nishimima et al. | 127/46.1 |
| 3,914,410 | 10/1975 | Godfrey | 424/131 |
| 3,994,743 | 11/1976 | Paley | 127/48 |
| 4,039,348 | 8/1977 | Hunwick | 127/9 |
| 4,115,147 | 9/1978 | Shimizu et al. | 127/54 |
| 4,156,618 | 5/1979 | Iwami et al. | 127/46 |
| 4,234,350 | 11/1980 | Suzor | 127/48 |
| 4,523,959 | 6/1985 | Exertier | 127/46.2 |
| 4,871,397 | 10/1989 | Stevens | 127/55 |
| 4,950,332 | 8/1990 | Stringfield et al. | 127/55 |
| 5,096,500 | 3/1992 | San Miguel Bento | 127/46.2 |

FOREIGN PATENT DOCUMENTS

| | | | |
|---|---|---|---|
| 0635578A1 | 1/1995 | France | C13F 1/14 |

OTHER PUBLICATIONS

*Application of ultrafiltration and reverse osmosis to cane juice,* by R. F. Madsen, M.Sc., Research Dept., A/S De Danske Sukkerfabrikker, Nakskov, Denmark (pp. 163–167).

*Primary Examiner*—Paul Lieberman
*Assistant Examiner*—Patricia L. Hailey
*Attorney, Agent, or Firm*—Pravel, Hewitt, Kimball & Krieger

[57] ABSTRACT

Refined sugar is produced directly from sugarcane without using conventional refining processes. Clarification of extracted cane juice is obtained either by ultra-centrifugation or ultra-filtration, and removal of certain compounds responsible for adverse color quality and viscosity is effected through a set of packed columns filled with an absorbent for these compounds. After evaporation and crystallization, refined cane sugar is produced.

34 Claims, No Drawings

PROCESS FOR PRODUCING REFINED SUGAR DIRECTLY FROM SUGARCANE

SPECIFICATION

1. Field of the Invention

This invention relates to the purification of cane juice so that refined white sugar can be produced directly from sugarcane.

2. Background of the Invention

This invention relates to the satisfaction of the sweet tooth. Specifically, it relates to a radical new way of producing high-quality refined cane sugar from the sugarcane plant. However, to fully understand its significance, it is necessary to understand some basic information about what cane sugar is and how it has heretofore been mass-produced.

Cane sugar is a name commonly used to refer to crystalline sucrose, a dissacharide compound used throughout the world in food-processing applications as a sweetener. Crystalline sucrose is primarily produced from the sugarcane plant, a plant which is cultivated in the tropical and semi-tropical regions of the earth.

Throughout the world today, refined cane sugar from sugarcane has been accomplished in two steps: (a) the raw sugar process; and (b) the refinery process.

In the raw sugar process, sugar mills, located in or near the cane fields, convert the harvested sugarcane plant into a commodity of international commerce known as raw sugar. The raw sugar is transported to sugar refineries, located in population centers throughout the world, where it is converted into its various refined end products. In contrast to the sugar mill, almost the entire output of the sugar refinery is intended, in one form or another, for human consumption.

It should be noted that there have historically been a few classes of unrefined sugar which are intended for human consumption, although they account for but a small proportion of the sugar consumed. One example is whole sugar, a sugar product made by boiling down the cane juice extracted from the sugarcane plant, without the elimination of any impurities. The mixture solidifies upon cooling and is ground resulting in a dark-brown rock-hard sugar product known as jaggery, panela, or muscovado.

Another crude sugar product is plantation white. This product is a bit more visually attractive, but it is only slightly more refined than whole sugar. Basically, plantation white is made directly from the sugarcane plant without going through the raw sugar stage. It is generally a local product of sugar mills, sold at a discounted price, because, although it is perfectly edible, it is not nearly as pure as refined sugar and it cannot be stored for as long.

In the production of raw sugar in the sugar mill, the sugarcane stalks are chopped into small pieces. Then, cane juice is extracted from the sugarcane, leaving behind a fibrous material called bagasse. The extracted juice is then clarified, in part by settling and in part by the addition of heat and lime, which induces precipitation of a floc which, upon removal, enhances the clarification. In many sugar mills, sulfur dioxide is bubbled through the juice, resulting in a bleaching effect which yields a lighter-colored raw sugar. The clarified juice is then processed through a series of evaporators to eliminate water, which is approximately 85% of the cane juice, resulting in a concentrated sugar solution called syrup. The syrup is then put through a crystallization process, which generates sugar crystals and further separates impurities. Finally, centrifugation separates raw sugar from the syrup, now termed molasses. The molasses is usually processed more than once so that as much of the sugar as possible can be recovered from the syrup.

In the sugar refinery, the raw sugar is cleaned and then melted. Then, the sugar solution is clarified to remove precipitates and other particulate matter. In anticipation of the clarification process, it is commonplace to add substances such as lime which coagulate some of the impurities and form precipitates, as in the raw sugar manufacturing process. Then, the sugar solution is filtered to remove the precipitates. Typically, the decolorization step which follows is accomplished by carbon adsorbents, such as bone char or activated carbon. In a majority of cases, sulphur dioxide is used to still further improve (bleach) the visual appearance of the resulting sugar. Although carbon adsorbents remain the principal method of decolorization, it should be noted that, because many colorants are of an anionic character, some refineries have chosen to use ion exchange units for color removal. At this point, the sugar solution is crystal clear with no turbidity. The sugar solution is passed through evaporators to remove the water and the remaining product is then passed to a vacuum pan for further evaporation and crystallization. A vacuum pan is basically an evaporator which allows for the evaporation of water at a reduced temperature, so that there is less thermal destruction of the sucrose. The end product is then passed through centrifuges to separate the white crystals from the mother liquor.

This basic process, raw sugar manufacturing followed by raw sugar refining, is the process commonly used throughout the world today to produce high-quality white refined cane sugar with a polarization (or, optically measured purity) of from about 99.40% to 9.99%. It is a two-step process which is employed even in locations where there is a sugar refinery near, or even within, a sugar mill. Even entities outside the sugar industry have arranged their business affairs to accommodate this state of the technology. Raw sugar is traded worldwide as a commodity on the New York and London stock exchanges.

Thus, heretofore, the sugar mills have produced crude sugar products, their main product being raw sugar. The high-quality refined sugars demanded in major population centers, however, have come from another source: the sugar refinery. The sugar refinery is a technologically sophisticated operation that employs expensive equipment and numerous chemicals in order to produce the refined sugar product.

The invention now makes it possible for the sugar mill to produce high quality refined sugar, thus bypassing the sugar refinery. Not only is the conventional refinery eliminated, but, in addition, so is the need for many of the expensive and/or hazardous chemicals presently employed in these refineries. Thus, the invention additionally benefits the U.S. public generally in that it facilitates the conservation of energy and material resources and minimizes, at the source, chemicals which are frequent contributors to environmental pollution.

SUMMARY OF THE INVENTION

The invention provides a process for transforming sugarcane into refined cane sugar. In the invention, particulate matter, colloidal particles, and compounds responsible for viscosity, ash, and color development (e.g., hydroxy methylfurfurals [hereinafter, "HMF"], dextrans, ketosylamines and the like) are removed. The contaminants are removed by an ultra-clarification process, intended to remove particulate matter and/or undissolved solids having a size of from about 0.1 to 1.0 microns, preferably from about 0.2 to 0.5 microns, followed by a special adsorption process. Performance of the process results in the direct production of refined sugar. The process therefore completely eliminates the need for the conventional refining process steps used in conventional sugar refineries.

DETAILED DESCRIPTION OF PREFERRED EMBODIMENT

The preferred embodiment of the process herein disclosed for producing refined sugar directly from sugarcane stalks includes several steps. Briefly, the cane juice must first be extracted from the sugarcane stalks. This extracted cane juice is then heated and its pH is elevated. An intense clarification process follows to remove particulate matter. The clarified cane juice is then treated by contacting it with an adsorbent resin. The treated cane juice is then separated from the adsorbent resin. Finally, refined sugar is separated from the treated cane juice by crystallization and centrifugation. Each of these steps, and variations thereof, are discussed in more detail below.

The first step of the preferred process is the step of extracting the cane juice from cut sugarcane stalks. This is accomplished either by milling, in which the cane is pressed between heavy rollers, or by diffusing, in which the sugar is leached out by water, or by a combination of milling and diffusing. In either case, the cane is prepared by being broken and/or cut into pieces measuring a few centimeters in length to improve the efficiency of the milling and/or diffusing process. This extraction operation produces two streams. The first stream is the cane juice, which is further processed as described below. The second stream is the fibrous residue from the cane, termed bagasse, which is commonly sent to the boiler house for energy production. At this point, the extracted cane juice features the following properties: color of from about 15,000 to 20,000 sugar color units; purity of from about 82% to 87%; a suspended solids content of from about 1.0% to 1.9%; a brix of from about 13% to 15%; and a dextrans concentration of from about 1,000 to 3,000 parts per million (ppm).

The extracted cane juice stream is now heated to a temperature of from about 80° C. to 105° C., with a preferred range of from about 85° C. to 95° C. This elevation in temperature halts the microbiological degradation of sugar which begins the moment the sugarcane is cut.

The extracted cane juice is next treated to raise its pH to from about 7.0 to 8.5, with a preferred range being a pH range of from about 7.0 to 7.3. The elevation of pH is necessary to prevent hydrolysis of the sucrose which occurs under evenly mildly acidic conditions, to precipitate insoluble salts, and to coagulate albumin and varying proportions of waxes and gums. One method of elevating the pH is by the addition of lime, which features the added advantage that calcium from the lime yields many insoluble salts. The precipitate of insoluble salts and other impurities (termed a "floc") may be removed by settling.

In an alternative embodiment, the extracted cane juice is heated and pH adjusted in a stepwise manner as follows. First, the extracted cane juice is heated to a temperature of from about 70° C. to 73° C. Then, it is pH-adjusted (e.g., by adding lime) to from about 7.2 to 7.8, so as to obtain after clarification a clarified juice with a pH of from about 7.0 to 7.3. Finally, the extracted cane juice stream is again heated, this time to its final optimum target temperature range of from about 85° C. to 95° C.

After removal of the precipitate by settling, the clarification step preferably features either ultra-filtration or ultra-centrifugation. Whether ultra-filtration or ultra-centrifugation is employed, the objective of this step of the process is the removal of particulate matter and/or undissolved solids having a size of from about 0.1 to 1.0 microns, preferably from about 0.2 to 0.5 microns, from the juice. Note: 1 micron=10,000 angstrom=0.00004 inch. At this point, the clarified cane juice features the following properties: color of from about 4,500 to 5,000 sugar color units; purity of from about 84% to 89%; a suspended solids content of about 0.05%; a brix of from about 13% to 15%; a dextrans concentration of from about 100 to 200 parts per million (ppm); a kestose/HMF removal percentage of from about 45% to 60%; an ash content of from about 0.1% to 0.3%; and some turbidity.

The terms ultra-filtration and ultra-centrifugation are frequently used in the art to designate clarification processes which remove particles on the order of 1 micron or less in size. Ultrafiltration is a pressure-driven membrane process capable of separating solution components on the basis of molecular size and shape. Under an applied pressure differential across the ultrafiltration membrane, solvent and small solute species pass through the membrane and are collected as the permeate; larger solute species are retained by the membrane and recovered as the concentrated retentate.

When the clarification step is effected by ultra-filtration, either mineral or organic membranes may be used. Mineral membranes (e.g., ceramic membranes, zirconia membranes, and alumina-based membranes) are usually chosen, because of the consistency of their pore diameters. These filters usually have a support material of either carbon or stainless steel. When using these filters, it is desirable to maintain a cross-flow velocity across the surface of the membrane of from about 2 to 6 meters/second, and preferably from about 3 to 5 meters/second, in order to avoid fouling of the pores of the membrane. Also, in the case of the mineral membrane, the pH of the clarified juice will frequently have to be from about 6.8 to 8.0 in order to avoid destroying the crystalline structure of the membrane.

Organic membranes (e.g., polyethersulfone materials blended with a hydrophilic cross-linking agent and the like) are sometimes used, because they have a wider pH tolerance, excellent chemical resistance, and good mechanical strength. In order to use these membranes, a temperature of from about 60° C. to 80° C., preferably from about 65° C. to 70° C., will be necessary for several reasons, including (1) avoiding bacterial growth; (2) allowing for the use of sodium hydroxide for cleaning of the pores when fouled; and finally (3) enhancing the performance of the filter, so that a sustained flow rate through the filter of from about 0.01 to 1.0 gallons per minute per square foot of membrane (gpm/ft$^2$), preferably from about 0.1 to 0.3 gpm/ft$^2$ of membrane, may be maintained.

Whether mineral or organic membranes are employed, good processing efficiencies are obtained when the filtered clarified juice (or, permeate) represents more than 98% of the feed to the membrane, and the retentate (i.e., the colloidal matter and macromolecules with a size larger than the cut-off of the membrane) represents less than 2% of the feed. For this reason, a screening step may be performed prior to the filtration, in which conventional screening methods are employed to remove particulate matter and/or undissolved solids having a size of from about 200 to 1,000 microns, preferably from about 300 to 500 microns.

When the solvent transports towards the membrane surface, it carries solute which is rejected at the membrane surface, resulting in an accumulation of solute on the membrane. This accumulation can lead to the formation of a gel layer or secondary membrane. The resistance of the gel layer can be greater than that of the membrane, particularly if the gel layer is allowed to become excessively thick and/or compacted. This occurrence, termed fouling of the membrane pores, is a recurrent problem. Fouling can be reduced, and periods of operation extended, however, by adding at periodic intervals a pulse (or, backwash) step, during which the flow through the filter is briefly reversed opening blocked pores. At less frequent intervals, the membrane is cleaned to remove the particulate matter collected. A substantial increase in the differential pressure between the feed side and the permeate side of a filter to a predetermined level is used to determine when to backwash/clean the filter.

Large scale implementation of this process normally derives efficiency gains from either (a) the parallel operation of several filters, with at least one filter being cleaned or awaiting service, so that continuous filtration is available, and/or (b) multistage, or serial operation, of several filters. Multistage operation is best understood in comparison to batch and single-stage operations. In a batch filtration, the feed solution is pumped continuously from a holding tank, through an ultrafiltration unit, and then back into the holding tank. As solvent is removed, the level in the holding tank falls and solution concentration increases. In the similar single-stage continuous operation (also termed a "feed and bleed" process), a feed stream is pumped from a holding tank into the circuit of a larger circulation stream, in which a large pump is used to pump the stream continuously through the membrane unit. The concentrated product is bled from the circuit at the same rate as the feed stream. A multi-stage continuous filtration operation employs the "bleed" from stage n as the "feed" for stage n+1. Each stage operates at essentially a constant concentration, which increases from the first stage to the last. The concentration of the bleed from the last stage is the final concentration of the multistage process.

In the multi-stage process, the temperature of the ultrafiltration process is usually maintained from about 65° C. to 80° C., preferably from about 68° C. to 72° C., in each stage. In the recirculation loop of each stage, the recirculation stream usually operates at from about 100% to 180% of feed flow, preferably from about 115% to 143% of the feed flow.

Although the objective of the ultraclarification step of the process is the removal of particulate matter and/or undissolved solids having a size of from about 0.1 to 1.0 microns, preferably from about 0.2 to 0.5 microns, from the juice, experiments have indicated that the invention results in an extremely high quality sugar when the ultraclarification step comprises an ultrafiltration process with a membrane having a pore size as small as 0.01 micron.

Centrifuges remove or concentrate particles of solids in a liquid by causing the particles to migrate through the fluid radially toward or away from the axis of rotation, depending on the density difference between the particles and the liquid. Although the discharge of the liquid may be intermittent, in most commercial centrifuges, the liquid phase discharge is continuous; the heavy solid phase is deposited against the bowl wall for intermittent or continuous removal. Although the specific geometry employed will be dictated, in large part, by economics, tubular-bowl, disk, and nozzle discharge centrifuges are all believed to be effective. In tubular-bowl centrifuges, the bowl is suspended from an upper bearing and drive assembly through a flexible-drive spindle. It hangs freely with only a loose guide in a controlled damping assembly at the bottom. Thus, it can find its natural axis of rotation if it becomes slightly unbalanced because of its process load. Feed enters the bottom of the bowl through a stationary feed nozzle under pressure. The pressure and nozzle size are selected to give a clean jet upward into the bowl at the desired flow rate. The incoming liquid is accelerated to rotor speed, moves upward through the bowl as an annulus, and discharges at the top. Solids travel upward with the liquid and, at the same time, receive a radial velocity based on their size and weight in the centrifugal force field. If the trajectory of a given particle intersects the wall, it is removed from the fluid; if it does not, the particle appears in the effluent.

In disk centrifuges, feed is admitted to the center of the bowl near its floor and it rises through a stack of sheet-metal truncated cones (termed disks) spaced a few millimeters apart. Each disk features holes which form channels through which the liquid rises. Nozzle-discharge centrifuges frequently employ an overall geometry similar to that of the disk centrifuge, except that, in addition, they feature numerous nozzles at the periphery of the bowl. These nozzles effect continuous discharge of the solids.

If the clarification step is effected by ultra-centrifugation, it has been discovered that, in order to achieve the separation (or, cutoff) of particulates with a size larger than 1000 angstroms, it is necessary to obtain a centrifugal force of from about 4,500 to 12,000 times the force of gravity [hereinafter the G-value], preferably from about 5,000 to 6,500 G-value. It has also been discovered that, during the centrifugation, oxidation either of the feed or of the discharged product, due to the presence of ambient air, has to be avoided. This is accomplished by means of a hydrohermetic seal.

A typical design of a continuous centrifuge useful for this process incorporates a conical stack of discs in order to provide a greater surface area on which solids can collect. During the centrifugation process, the temperature is maintained from about 60° C. to 82° C., preferably from about 74° C. to 80° C.

As in the case where clarification is effected by filtration, a screening step may be performed prior to the centrifugation, in which conventional screening methods are employed to remove particulate matter and/or undissolved solids having a size of from about 200 to 1,000 microns, preferably from about 300 to 500 microns.

The clarified cane juice is then treated by contacting it with an adsorbent resin. The objective of this step of the process is the adsorption/removal of a variety of different macromolecular contaminants, some of which are responsible for adverse color formation and some of which are responsible for a less-than-optimal viscosity in the cane juice to be subsequently processed. At this point, the treated/adsorbed cane juice features the following properties: color of from about 1,000 to 3,500 sugar color units; purity of from about 85% to 90%; a suspended solids content of about 0.05%; a brix of from about 13% to 15%; a dextrans concentration of from about 10 to 50 parts per million (ppm); a kestose/HMF removal percentage of from about 90% to 95%; an ash content of from about 0.005% to 0.200%; no turbidity; and a viscosity at 20° C. and 15 brix of about 1.8 centipoise.

The adsorbent resin used is made at least in part from a macroporous copolymer of a monovinyl aromatic monomer and a crosslinking monomer, wherein the macroporous copolymer has been post-crosslinked in the swollen state in the presence of a Friedel-Crafts catalyst and functionalized with hydrophilic groups. Adsorbent resins of this type are disclosed in U.S. Pat. No. 4,950,332 to Stringfield et al. [hereinafter the "'332 patent"], herein incorporated in its entirety by reference.

The contact time required to adsorb the contaminants can be expected to vary with several factors, including, e.g., the properties of the resin, the amount of contaminants present, the degree of adsorption desired, the amount of resin employed, and the properties of the sugar solution. Thus, generally speaking, the contact time must be empirically determined.

Although the contacting and the separating of the clarified cane juice and the resin may be effected in a batch or semi-batch manner, a common alternative method is the use of packed columns, in which the clarified cane juice flows continuously through a packed bed of the resin at such an average velocity that it exits same after an average residence time appropriate for the desired treatment. Although some experimentation will doubtless be required, the inventor's experience indicates that, if this approach is employed, the flow rate should be in the range of about 0.017 to 0.170 gallons per minute per gallon of resin, preferably in the range of about 0.04 to 0.06 gpm/gal resin. The pressure drop should be in the range of from about 1 to 8 pounds per square inch per foot of bed depth for resins of the type disclosed, preferably from about 2 to 4 psi/foot. The ratio of the height of the resin bed to the column diameter should be in the range of from about 0.5 to 5.0, preferably in the range of from about 1 to 4. The resulting retention time is therefore in the range of from about 6 to 60 minutes, preferably from about 20 to 30 minutes.

Refined sugar is then separated from the treated cane juice by evaporation and crystallization. Evaporation is necessary, because the concentration of sucrose in the treated cane juice must reach a certain point before crystals can be generated. To conserve energy, multiple-effect evaporators are commonly employed. Because sugar is heat-sensitive, crystallization is accomplished in vacuum pans, which allow for evaporation and crystal formation at a reduced temperature and pressure. At this point, the evaporated cane juice features the following properties: color of from about 1,000 to 3,500 sugar color units; purity of from about 85% to 90%; a suspended solids content of about 0.05%; a brix of from about 55% to 70%; a dextrans concentration of from about 10 to 50 parts per million (ppm); a kestose/HMF removal percentage of from about 90% to 95%; and no turbidity.

When the vacuum pan is full, the feed is stopped, and a batch mixture (termed the massecuite) of crystals and syrup is discharged. The massecuite is fed to a centrifuge, so that, by centrifugal force, the sugar crystals may be isolated from the syrup. At this point, the final sugar product features the following properties: color of from about 5 to 35 sugar color units; purity of from about 99.6% to 99.9%; and an ash content of from about 0.005% to 0.02%; and no turbidity.

As this disclosure demonstrates, the quality of the cane juice in-process and of the refined sugar product is tested by reference to the several physical properties, most of which are calculated according to the procedures recommended by the ICUMSA (International Commission for Uniform Methods of Sugar Analysis). Polarization is a measurement of the optical rotation of a plane of polarized light as it passes through a solution. A saccharimeter is a polarimeter modified for use in the sugar industry; the device directly indicates the sucrose concentration, also termed the direct polarization (abbreviated pol). Suspended solids refers to the percentage by weight of non-dissolved solids in a solution. Density measurements are made using a standard hydrometer, called a spindle, to determine the sugar concentration in syrups, liquors, juices and molasses. These hydrometers are calibrated to yield a pure sucrose concentration (percent sucrose by weight) termed a Brix reading; however, since the density of other sugar solutions is not very different, the Brix reading is considered a measure of total dissolved solids. Suspended solids is the percentage by weight of non-dissolved solids. Purity is understood to denote sucrose content as a percentage of total solids, so it is calculated as pol/Brix (and multiplied by 100 to normalize same to a 100% scale).

It has been observed, by way of comparison, that the clarified cane juice of the raw sugar process typically features the following properties: color of from about 15,000 to 18,000 sugar color units; purity of from about 83% to 89%; suspended solids of from about 0.8 to 1.5%; brix of from about 55% to 64%; a dextrans concentration of from about 500 to 1500 parts per million (ppm); a viscosity at 15 brix and 20° C. of about 3.8 centipoise; and a kestose/HMF removal percentage of about 20%. Typically, the clarified and decolorized cane juice of the sugar refinery features the following properties: color of about 2,500 sugar color units; purity of from about 94% to 97%; suspended solids of about 0.1; brix of from about 55% to 64%; a dextrans concentration of from about 100 to 200 ppm; a viscosity at 15 brix and 20° C. of about 2.6 centipoise; and a kestose/HMF removal percentage of about 70%. By contrast, the clarified and adsorbed cane juice of the present invention typically features the following properties: color of from about 1,000 to 3,500 sugar color units (prior to the ultra-filtration or ultra-centrifugation, the cane juice has a color of from about 14,000 to 20,000); purity of from about 85% to 90%; suspended solids of about 0.05%; brix of from about 13% to 15% prior to evaporation; a dextrans concentration of from about 10 to 50 ppm; a viscosity at 15 brix and 20° C. of about 1.8 centipoise; an ash content of from about 0.005% to 0.200%; no turbidity; and a kestose/HMF removal percentage of from about 90% to 95%.

Although other properties may be tracked for control purposes, if the process of the invention as outlined herein is followed, and ordinary good process controls are maintained, the refined sugar resulting from the process described above will at least have a color less than about 35 sugar color units, an ash content of less than 0.02% = 0.0002, and a polarization of at least 99.6%. This may be contrasted with (a) typical raw sugar, which features a color of greater than 900 sugar color units, an ash content of greater than 0.1%, and significant turbidity and odor, and (b) typical refined sugar, which features a color of from about 10 to 40 sugar color units, an ash content of about 0.02%, no turbidity and some odor.

The following examples are illustrative of the invention and do not limit the scope of the invention as described above and claimed herebelow.

EXAMPLE 1

Cane juice was extracted by milling sugarcane stalks cultivated in Louisiana. The milled cane juice was screened by means of DSM screens manufactured by Dorr-Oliver with a pore size of 0.5 millimeter. The extracted cane juice was heated by means of a heat exchanger to a temperature of 88° C. and thereupon sent to a liming process where lime was added in order to reach a pH of 7.4. The limed cane juice was then heated to about 99° C. by means of a heat exchanger.

The heated limed cane juice was then sent to a cone clarifier to remove settling solids, so that the suspended solids content of the overflow clarified cane juice is less than or equal to about 0.5%. This clarified cane juice was then sent to a DSM screen with a pore size (or, aperture) of 300 micron. Filtration through a Membralox filter, a ceramic (or, mineral) filter, via a feed and bleed process, followed. The filter had an aperture size of 1000 angstroms and was operated by maintaining a cross flow velocity of about 4 meters/second to avoid fouling and a pH of about 7.4 to avoid destruction of the crystalline structure of the membrane. The permeate flow represented about 99% of the feed flow; a recirculation rate of 130% of the feed flow was maintained. Serial adsorption through two beds of Dow Chemical Company's OPTIPORE® resin followed. The flow rate through the columns was about 0.05 gpm/gal resin, the ratio of the depth of the bed to the diameter of the cylindrically shaped bed was about 4, the pressure drop was about 2.5 psi/foot resin depth, and the resulting retention time was about 20 minutes.

This was followed by evaporation, whereby the resulting syrup featured a brix of about 71%. Crystallization was effected at a supersaturation of 1.15 in a vacuum pan. The temperature of the mass was about 78° C. Isolation of the crystals was effected in a batch centrifuge. The crystalline end product featured a color of 10 sugar color units, calculated by the ICUMSA method, an ash content of less than 0.005%, a polarization of about 99.8%, and no turbidity.

EXAMPLE 2

Cane juice was extracted by milling from sugarcane stalks cultivated in Mexico. The milled cane juice was screened by means of a contra-shear rotating assembly using Johnson screens with a pore size of 1 millimeter. The extracted cane juice was sent to a continuous liming process where 0.6% lime was added in order to reach a pH of 7.5. The extracted cane juice was then heated in two stages by means of tubular heat exchangers to a first-stage exit temperature of about 85° C. and a second-stage exit temperature of about 102° C.

The heated limed cane juice was then sent to a clarifier to remove settling solids, so that the suspended solids content of the overflow clarified cane juice is less than or equal to about 1.0%. This clarified cane juice was then sent to a DSM screen with a pore size (or, aperture) of 500 micron. The cane juice was then sent to a nozzle-discharge bowl centrifuge. This centrifuge applied a force of about 8,000 G and culled suspended matter having a size of about 0.6 micron. Serial adsorption through a set of two columns followed; the columns featured a bed of Dow Chemical Company's OPTIPORE® resin. The flow rate was about 0.083 gpm/gal resin, the ratio of the depth to the diameter of the cylindrically shaped bed was about 2, the pressure drop was about 1.8 psi/foot of resin bed depth, and the retention time was about 12 minutes.

This was followed by evaporation whereby the resulting syrup featured a brix of about 68%. Crystallization was effected at a supersaturation of about 1.2 and a temperature of about 81° C. The crystalline end product featured a color of 15 sugar color units, calculated by the ICUMSA method, an ash content of less than 0.015%, and no turbidity.

What is claimed is:

1. A process for producing refined sugar directly from sugarcane stalks in the absence of added chemical components comprising the following steps:

(a) extracting cane juice from the sugarcane stalks;

(b) heating the extracted cane juice;

(c) raising the pH of the extracted cane juice;

(d) ultra-clarifying the extracted cane juice to remove particulate matter and/or undissolved solids greater than from about 0.1 to 1.0 micron, wherein said ultra-clarifying is performed by a process step selected from the group consisting of ultrafiltration, ultracentrifugation, and screening;

(e) treating the ultra-clarified cane juice by contacting the ultra-clarified cane juice with an adsorbent resin, wherein said adsorbent resin is made at least in part from a macroporous copolymer of a monovinyl aromatic monomer and a crosslinking monomer, wherein the macroporous copolymer has been post-crosslinked in the swollen state in the presence of a Friedel-Crafts catalyst and functionalized with hydrophilic groups;

(f) separating the treated cane juice from the adsorbent resin;

(g) separating refined sugar from the treated cane juice; and (h) wherein, in steps (a) through (d), the cane juice includes particulate and colloidal matter from said sugarcane stalks and is maintained in a liquid condition.

2. The process of claim 1 wherein the step of heating the cane juice comprises heating the cane juice to a temperature of from about 80° C. to 105° C. cane juice to remove undissolved solids having a size of from about 0.1 to 1.0 micron.

3. The process of claim 1 wherein the step of raising the pH of the extracted cane juice comprises raising the pH of the extracted cane juice to between about 7.0 to 8.5.

4. The process of claim 3, wherein the step of raising the pH of the extracted cane juice comprises raising the pH to between about 7.0 to 7.3.

5. The process of claim 1 wherein the step of ultra-clarifying the extracted cane juice comprises ultra-filtering the extracted cane juice with a membrane having a pore size of about 0.01 micron to remove particulate matter and/or undissolved solids.

6. The process of claim 1 wherein the step of ultra-clarifying the extracted cane juice comprises screening the extracted cane juice to remove particulate matter having a size greater than from about 200 to 1,000 microns and then filtering the screened extracted cane juice to remove particulate matter and/or undissolved solids having a size of greater than from about 0.1 to 1.0 micron.

7. The process of claim 1 wherein the step of ultra-clarifying the extracted cane juice comprises centrifuging the extracted cane juice at a centrifugal force of from about 4,500 G to about 12,000 G to remove particulate matter and/or undissolved solids.

8. The process of claim 1 wherein the step of ultra-clarifying the extracted cane juice comprises screening the extracted cane juice to remove particulate matter having a size greater than from about 200 to 1,000 microns and then centrifuging the screened extracted cane juice to remove particulate matter and/or undissolved solids having a size of greater than from about 0.1 to 1.0 micron.

9. The process of claim 8 wherein the step of ultra-centrifuging the screened extracted cane juice comprises applying a centrifugal force of from about 4,500 G to 12,000 G.

10. The process of claim 1 wherein the separated treated cane juice has a color of from about 1,200to 18,000 sugar color units, as measured by the ICUMSA method.

11. The process of claim 1 wherein the separated treated cane juice has a viscosity of from about 1.0 to 5.0 centipoise, at a temperature of from about 10° C. to 90° C.

12. The process of claim 1 wherein the step of heating the extracted cane juice comprises heating to a temperature of between about 80° C. to 105° C.

13. The process of claim 12 wherein the step of heating the extracted cane juice comprises heating to a temperature of between about 85° C. to 95° C.

14. The process of claim 1 wherein the step of ultra-clarifying the extracted cane juice comprises removing particulate matter and/or undissolved solids having a size greater than from about 0.2 to 0.5 micron.

15. A refined sugar product produced by the process of any of claims 1 through 11, inclusive, or 4 through 14, inclusive.

16. A process for purifying extracted cane juice in the absence of added chemical components comprising the following steps:

(a) ultra-clarifying the extracted cane juice to remove particulate matter and/or undissolved solids greater than from about 0.1 to 1.0 micron, wherein said ultra-clarifying is performed by a process step selected from the group consisting of ultrafiltration, ultracentrifugation, and screening; and (b) treating the ultra-clarified cane juice by contacting the ultra-clarified cane juice with an adsorbent resin for a predetermined period of time, wherein said adsorbent resin is made at least in part from a macroporous copolymer of a monovinyl aromatic monomer and a crosslinking monomer, wherein the macroporous copolymer has been post-crosslinked in the swollen state in the presence of a Friedel-Crafts catalyst and functionalized with hydrophilic groups.

17. The process of claim 16 wherein the step of ultra-clarifying the extracted cane juice comprises ultra-filtering the extracted cane juice with a membrane having a pore size of about 0.01 micron to remove particulate matter and/or undissolved solids.

18. The process of claim 17 wherein the step of ultra-filtering the extracted cane juice comprises filtering with a mineral membrane.

19. The process of claim 17 wherein the step of ultra-filtering the extracted cane juice comprises filtering with an organic membrane.

20. The process of claim 16 wherein the step of ultra-clarifying the extracted cane juice comprises screening the extracted cane juice to remove particulate matter having a size greater than from about 200 to 1,000 microns and then filtering the screened extracted cane juice to remove particulate matter and/or undissolved solids having a size of greater than from about 0.1 to 1.0 micron.

21. The process of claim 20 wherein the step of ultra-filtering the extracted cane juice comprises filtering with a mineral membrane.

22. The process of claim 20 wherein the step of ultra-filtering the extracted cane juice comprises filtering with an organic membrane.

23. The process of claim 16 wherein the step of ultra-clarifying the extracted cane juice comprises ultra-centrifuging the extracted cane juice at a centrifugal force of from about 4,500 G to about 12,000 G to remove particulate matter and/or undissolved solids.

24. The process of claim 16 wherein the step of ultra-clarifying the extracted cane juice comprises screening the extracted cane juice to remove particulate matter having a size greater than from about 200 to 1,000 microns and then centrifuging the screened extracted cane juice to remove particulate matter and/or undissolved solids having a size of greater than from about 0.1 to 1.0 micron.

25. The process of claim 24 wherein the step of centrifuging the screened extracted cane juice comprises applying a centrifugal force of from about 4,500 G to 12,000 G.

26. The process of claim 16 wherein the separated treated cane juice has a color of from about 1,200 to 18,000 sugar color units, as measured by the ICUMSA method.

27. The process of claim 16 wherein the separated treated cane juice has a viscosity of from about 1.0 to 5.0 centipoise, at a temperature of from about 10° C. to 90° C.

28. The process of claim 16, wherein the step of ultra-clarifying the extracted cane juice comprises removing particulate matter and/or undissolved solids having a size greater than from about 0.2 to 0.5 micron.

29. A refined sugar product produced by the process of any of claims 16 through 27, inclusive, or 28.

30. A process for purifying ultra-clarified cane juice in the absence of added chemical components with particulate matter and/or undissolved solids removed of greater than from about 0.1 to 1.0 micron, wherein said ultraclarifying is performed by a process step selected from the group consisting of ultrafiltration, ultracentrifugation, and screening, comprising the step of contacting the ultra-clarified cane juice with an adsorbent resin, wherein said adsorbent resin is made at least in part from a macroporous copolymer of a monovinyl aromatic monomer and a crosslinking monomer, where the macroporous copolymer has been post-crosslinked in the swollen state in the presence of a Friedel-Crafts catalyst and functionalized with hydrophilic groups and separating the treated cane juice from the adsorbent resin.

31. The process of claim 30 wherein the separated treated cane juice has a color of from about 1,200 to 18,000 sugar color units, as measured by the ICUMSA method.

32. The process of claim 30 wherein the separated treated cane juice has a viscosity of from about 1.0 to 5.0 centipoise, at a temperature of from about 10° C. to 90° C.

33. The process of claim 30, wherein the step of ultra-clarifying the extracted cane juice comprises removing particulate matter and/or undissolved solids having a size greater than from about 0.2 to 0.5 micron.

34. A refined sugar product produced by the process of claim 30 or 33.

* * * * *